US006085608A

United States Patent [19]

Santoro, Jr. et al.

[11] Patent Number: 6,085,608

[45] Date of Patent: Jul. 11, 2000

[54] INDEPENDENT BRAKE HANDLE ASSEMBLY

[75] Inventors: Ralph Santoro, Jr., New Kensington, Pa.; Paul J. Kettle, Jr., Ijamsville, Md.

[73] Assignee: Westinghouse Air Brake Co., Wilmerding, Pa.

[21] Appl. No.: 09/044,295

[22] Filed: Mar. 19, 1998

[51] Int. Cl.[7] ..... G05G 9/047

[52] U.S. Cl. ..... 74/471 XY; 74/491

[58] Field of Search ..... 74/471 XY, 491; 188/50

[56] References Cited

U.S. PATENT DOCUMENTS

| | | | |
|---|---|---|---|
| 3,360,620 | 12/1967 | Ward | 74/471 XY |
| 3,870,161 | 3/1975 | Cording | 74/471 XY |
| 3,993,175 | 11/1976 | Beveridge | 74/471 XY |
| 4,125,034 | 11/1978 | Wineburner | 74/471 XY |
| 4,587,510 | 5/1986 | Kim | 74/471 XY |
| 4,796,480 | 1/1989 | Amos et al. | 74/483 R |
| 5,519,299 | 5/1996 | Ferri et al. | 477/78 |

*Primary Examiner*—John A. Jeffery
*Assistant Examiner*—William C Joyce
*Attorney, Agent, or Firm*—James Ray & Associates

[57] ABSTRACT

A handle assembly, of the type used in railway locomotives, which includes a base plate, a cam mount attached to the base plate, a cam disk and a shaft assembly interconnecting the mount and disk to allow rotation of the disk. The improvement includes a yoke, a bail bar, first and second bearing members anchored to the plate and first and second switches attached to the plate. Pivotally connected to the disk and accommodating a handle, the yoke rotates along with the disk as the handle is moved along its range of motion and tilts as the handle is moved perpendicularly thereto. The bail bar is rotatable between the first and second bearing members. A first mechanism imparts a rotational force to the bail bar so that its middle section presses against an upper portion of the yoke. A stop limits rotation of the bail bar to a point at which the yoke and handle attain an untilted state. Operating against a lower portion of the yoke, a second mechanism provides a counterbalancing force to normally bias the yoke in the untilted state. No matter where the handle is positioned along its range of motion, when it is tilted by a preset amount, the yoke overcomes the rotational and counterbalancing forces so that a third mechanism causes both the first and second switches to change state.

20 Claims, 6 Drawing Sheets

INDEPENDENT BRAKE HANDLE ASSEMBLY

FIELD OF THE INVENTION

The invention generally relates to the independent brake handle and related components situated in the handle unit of a railway locomotive. More particularly, the invention pertains to an improvement in its design and construction that renders the independent brake handle assembly more reliable.

BACKGROUND OF THE INVENTION

A typical train includes one or more locomotives, a plurality of railcars and several trainlines. The trainlines include both pneumatic and electrical lines most of which run from the lead locomotive to the last railcar in the train. One pneumatic trainline is the brake pipe. The brake pipe consists of a series of individual pipe lengths each of which is secured to the underside of one railcar. Each pipe length is interconnected to another such pipe length via a flexible coupler situated between each railcar. Usually controlled so as to mimic the pressure contained within a storage tank called the equalizing reservoir, the brake pipe is thus one long continuous pipe that runs from the lead locomotive to the last railcar. The brake pipe supplies the pressurized air that is required by the brake control system to charge the various reservoirs and operate the brake control valves of each railcar in the train.

The pneumatic trainlines on a locomotive, in addition to the brake pipe, include a main reservoir equalizing (MRE) pipe, an independent application and release (IAR) pipe and an actuating pipe, the latter also known as the No. 13 pipe. Within a locomotive consist (i.e., two or more locomotives connected together), the MRE, actuating and IAR pipes of each locomotive connect to the MRE, actuating and IAR pipes of adjacent locomotives. The IAR pipe supplies the compressed air that may be used to control the delivery of pressurized air to, and thus to operate, the brakes of each locomotive in the train.

The brakes of a train, whether on railcars or locomotives, are applied using brake cylinders and associated components. During braking, the brake cylinders convert the pressurized air that they receive to mechanical force. From the brake cylinders this force is transmitted by mechanical linkage to the brake shoes. When the brakes are applied, it is the brake shoes that are ultimately used to slow or stop the rotation of the wheels on every vehicle in the train.

A typical locomotive has a brake control system such as any one of the various EPIC® Brake Equipment Systems produced by the Westinghouse Air Brake Company (WABCO). These brake control systems generally include a handle unit, a cab control computer, a keyboard, a display, a locomotive interface unit, a brake control computer and a pneumatic operating unit.

Depending on how a particular locomotive may be configured, the handle unit and the cab control computer may occupy physically separate enclosures or be housed within a single enclosure called the cab control unit, as shown in FIGS. 1 and 2A. The handle unit contains the automatic and independent brake handle assemblies, as shown in FIGS. 2B and 3. From the handle unit the cab control computer receives via an interface card the signals indicative of the positions of the brake handles. Based on these inputs, the cab control computer calculates brake control commands representative of how much, or even if, the braking effort of the train should be raised or reduced.

Combined with other data and encoded, the cab control computer conveys these commands to the brake control computer.

The keyboard permits a train operator to provide the various parameters necessary to set-up, and otherwise access, the brake control system. The display allows the operation of the brake equipment to be monitored. The locomotive interface unit (LIU) connects electrical power and certain trainlines to the brake equipment and provides various signals to the brake control computer. Based on the inputs it receives and the software that dictates its operation, the brake control computer controls the overall operation of the brakes. The brake control computer achieves such control by controlling the operation of the pneumatic operating unit (POU). It is chiefly the POU that affects the pressures in the pneumatic trainlines and in the various reservoirs so as to control the brakes according to the commands it receives from the brake control computer.

Among the devices comprising the POU are the independent application and release (IAR) control portion, the brake cylinder (BC) control portion and the brake pipe (BP) control portion. These operating portions of the POU are primarily controlled by the brake control computer. The IAR control portion features pneumatic logic circuitry along with solenoid operated valves by which the pressure in both the actuating and IAR pipes can be controlled. The BP control portion uses pneumatic logic circuitry and solenoid operated valves by which the pressure in the equalizing reservoir and brake pipe of the train can be controlled. The BC control portion features pneumatic logic circuitry along with solenoid operated valves by which the pressure in the brake cylinders on the locomotive can be controlled. The BC control portion controls pressure in the locomotive brake cylinders in response to the commands generated by movement of the brake handles or manifested as pressure changes in the brake pipe or IAR pipe.

A pressure switch (PS) portion senses the pressure in the brake pipe and the actuating pipe under both normal and loss of power conditions. Pressure switch 13A, for example, is used while the brake control system is controlled electronically under normal conditions. It closes when the No. 13 pipe is pressurized. Pressure switch 13B, however, is used while the brake control system has suffered a loss of power. Switch 13B is also set to close when the actuating pipe is pressurized.

Through the keyboard, the train operator can select the mode in which the locomotive brake equipment will be operated. In the LEAD CUT-IN mode, the brake control computer permits the locomotive operator to direct control of the train through both the automatic and independent brake handles. This gives the operator control over the brakes of both the locomotive(s) and the railcars. In the LEAD CUT-OUT mode, the brake control computer permits the locomotive operator to direct control only through the independent brake handle. This gives the operator control over the brakes of the locomotive(s) only. In the TRAIL mode, both brake handles are rendered inoperable except for the emergency position. In a locomotive consist, the brake equipment of one locomotive operating in the TRAIL mode is essentially subservient to the brake equipment of another locomotive operating in either of the LEAD modes. The operation of both the BP and IAR control portions is affected by the mode in which the locomotive is operated.

The automatic brake handle is the device that the train operator can manipulate to direct the brake equipment to apply and release the brakes on all of the locomotives and railcars in the train. The level to which the brake equipment reduces or increases pressure in the brake pipe, and thus the amount of braking power exerted by the train brakes, corresponds to the position of the automatic brake handle. The independent brake handle, in contrast, allows the train operator to apply and release the brakes only on the locomotive(s) of the train.

As best shown in FIG. 1, the automatic brake handle can be moved from and in between a release position at one extreme in which brake pipe pressure is maximum and the brakes are completely released to an emergency position at another extreme in which brake pipe pressure is zero and the brakes are fully applied. When the brakes are applied, reduction of the pressure in the brake pipe is generally controlled from the lead locomotive via the BP control portion. The exact amount by which the pressure is reduced depends into which of the application positions the handle is placed. It is this reduction in pressure that signals the brake control valve(s) on each railcar to supply pressurized air from the appropriate reservoir(s) to the brake cylinders to apply the railcar brakes. The automatic brake handle positions thus include release, minimum service, full service, suppression, continuous service and emergency. Between the minimum and full service positions lies the service zone wherein each incremental movement of the handle toward the full service position causes an incremental reduction in brake pipe pressure.

Also shown in FIG. 1, the independent brake handle can be moved from and in between a release position at one extreme to a full apply position at the other extreme. The range encompassing a point just next to the release position up to and including the full apply position is referred to as the application zone. When the handle is moved to the release position, the brake control computer commands the IAR control portion to vent air from a control reservoir. This prompts the IAR control portion to exhaust air from the IAR pipe. The BC control portion responds pneumatically to this loss in IAR pipe pressure by venting air from the brake cylinders to release the locomotive brakes.

When the independent brake handle is then moved into the application zone, the brake control computer commands the IAR control portion to increase proportionately the pressure in the control reservoir. The exact amount by which the reservoir pressure is increased depends on how far into the application zone the handle is placed. For example, when the handle is placed into its full apply position, the brake control computer commands the IAR control portion to increase the pressure in the control reservoir to a nominal maximum value appropriate to the type of train at issue. The IAR control portion reacts to this increase in control reservoir pressure by raising the pressure in the IAR pipe accordingly. Responding pneumatically to the resulting increase in IAR pipe pressure, the BC control portion directs air from the main reservoir to the brake cylinders to apply the locomotive brakes. The pressure in the IAR pipe and the locomotive brake cylinders thus reduces and increases in proportion to the position of the independent brake handle.

Another position in which the independent brake handle can be moved is the actuation position (also known as the bail off position), as best shown in FIGS. 1 and 2A. When held in the bail off position, the independent brake handle causes two microswitches, known as the actuation (or bail off) switch and loss of power (LOP) bail off switch, to close. The purpose for these switches is described in the ensuing paragraphs.

The independent brake handle assembly in its current design has exhibited less than the desired level of reliability. This is because the actuation and LOP bail off microswitches are disposed on a part of the assembly that moves during operation. Consequently, these two microswitches along with the wiring that connects to them have evidenced a tendency to wear out at a faster than expected rate. The invention described and claimed in this document has been devised to overcome this problem.

The foregoing background information is provided to assist the reader to understand the invention described and claimed below. Accordingly, any terms used herein are not intended to be limited to any particular narrow interpretation unless specifically stated otherwise in this document.

OBJECTIVES OF THE INVENTION

It is, therefore, a primary objective of the invention to provide a brake handle assembly that is more reliable than any of the currently available brake handle assemblies.

Another objective is to design a brake handle assembly in which the microswitches are fixed in position rather than disposed on a moveable part where they are more likely to suffer damage due to the stresses caused by such motion.

In addition to the objectives and advantages listed above, various other objectives and advantages of the invention will become more readily apparent to persons skilled in the relevant art from a reading of the detailed description section of this document. The other objectives and advantages will become particularly apparent when the detailed description is considered along with the following drawings and claims.

SUMMARY OF THE INVENTION

In a presently preferred embodiment, the invention provides an improvement to a handle assembly for a railway locomotive. The handle assembly is of the type that has a base plate, a cam mount attached to the base plate, a cam disk and a shaft assembly. The shaft assembly is used to interconnect the cam mount and the cam disk so as to allow the cam disk to be rotated. The improvement includes a yoke, a bail bar, first and second bearing members, first and second switches and three other mechanisms described hereinafter. Pivotally connected to the cam disk, the yoke provides a bore into which a handle secures. The yoke rotates along with the cam disk as the handle is moved along a range of motion and tilts as the handle is moved perpendicularly to its range of motion. The first and second bearing members are anchored to the base plate. The bail bar has a first end that is rotatable within and protrudes through the first bearing member. Similarly, the second end of the bail bar is rotatable within and protrudes through the second bearing member. The middle section of the bail bar operates against an upper portion of the yoke on a side thereof opposite the cam disk. The second bearing member features a stop block that prevents the yoke and handle therewith from moving beyond the first and last positions in its range of motion. A first mechanism imparts a rotational force to the bail bar so that its middle section presses against the yoke. The stop block also acts to limit the rotation of the bail bar against the yoke to a point at which the yoke and handle therewith attain an untilted state. A second mechanism operates against a lower portion of the yoke whereat it provides a counterbalancing force to normally bias the yoke in the untilted state. Each switch attaches to the base plate. Operating with the bail bar, a third mechanism is used to engage the switches. No matter where it is positioned along its range of motion, when tilted by a preset amount, the handle causes the yoke to overcome the rotational force of the bail bar and the counterbalancing force so that the third mechanism causes both of the first and the second switches to change state.

DETAILED DESCRIPTION OF THE INVENTION

Figure 1:
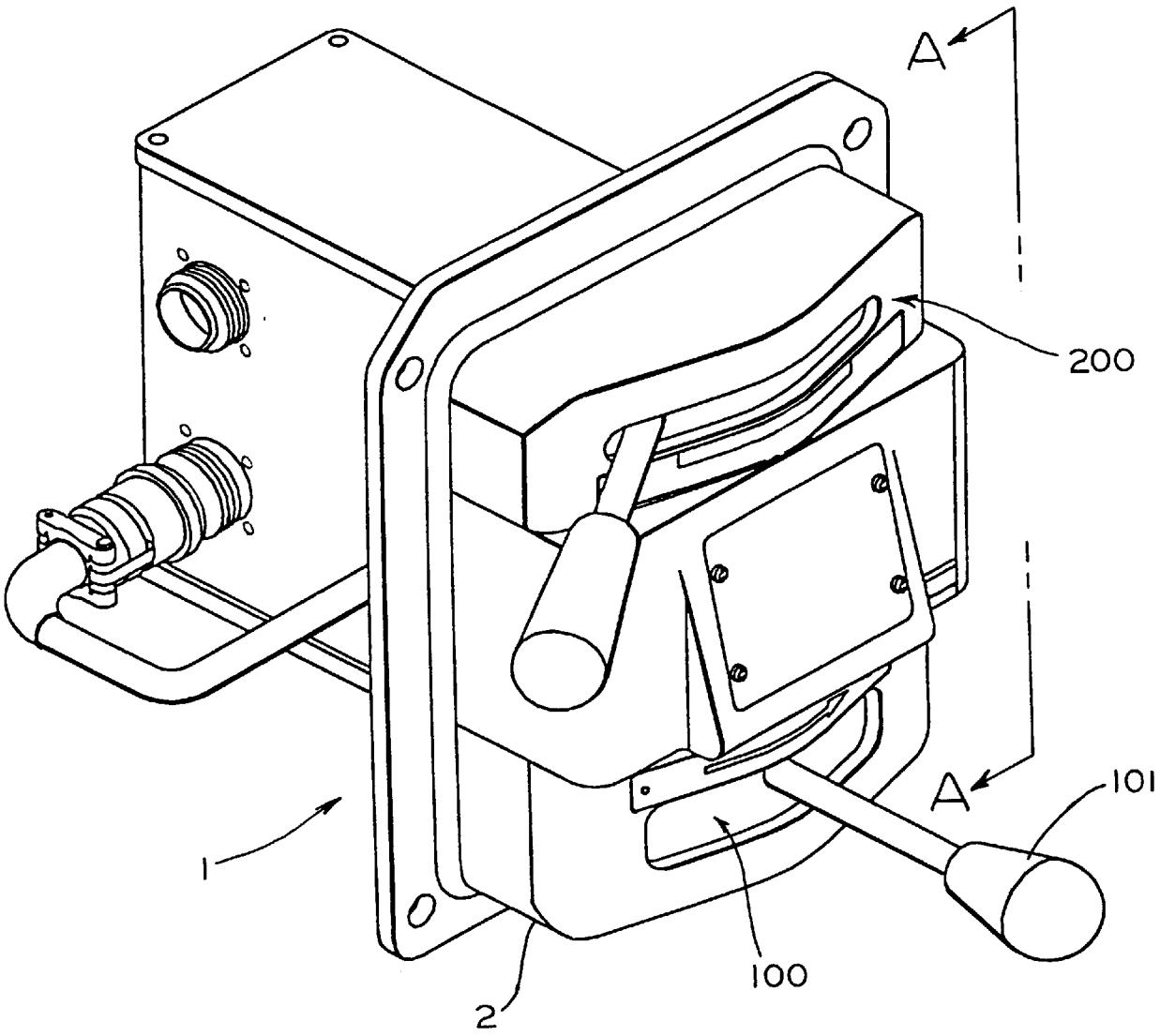
FIG. 1 PRIOR ART
FIG. 1 is a perspective view of a 26 Style Cab Control Unit showing the front, left and top sides of a handle unit and its automatic and independent brake handle assemblies.

Before describing the invention in detail, the reader is advised that, for the sake of clarity and understanding, identical components having identical functions have been marked where possible with the same reference numerals in each of the Figures provided in this document.

Figure 2A:
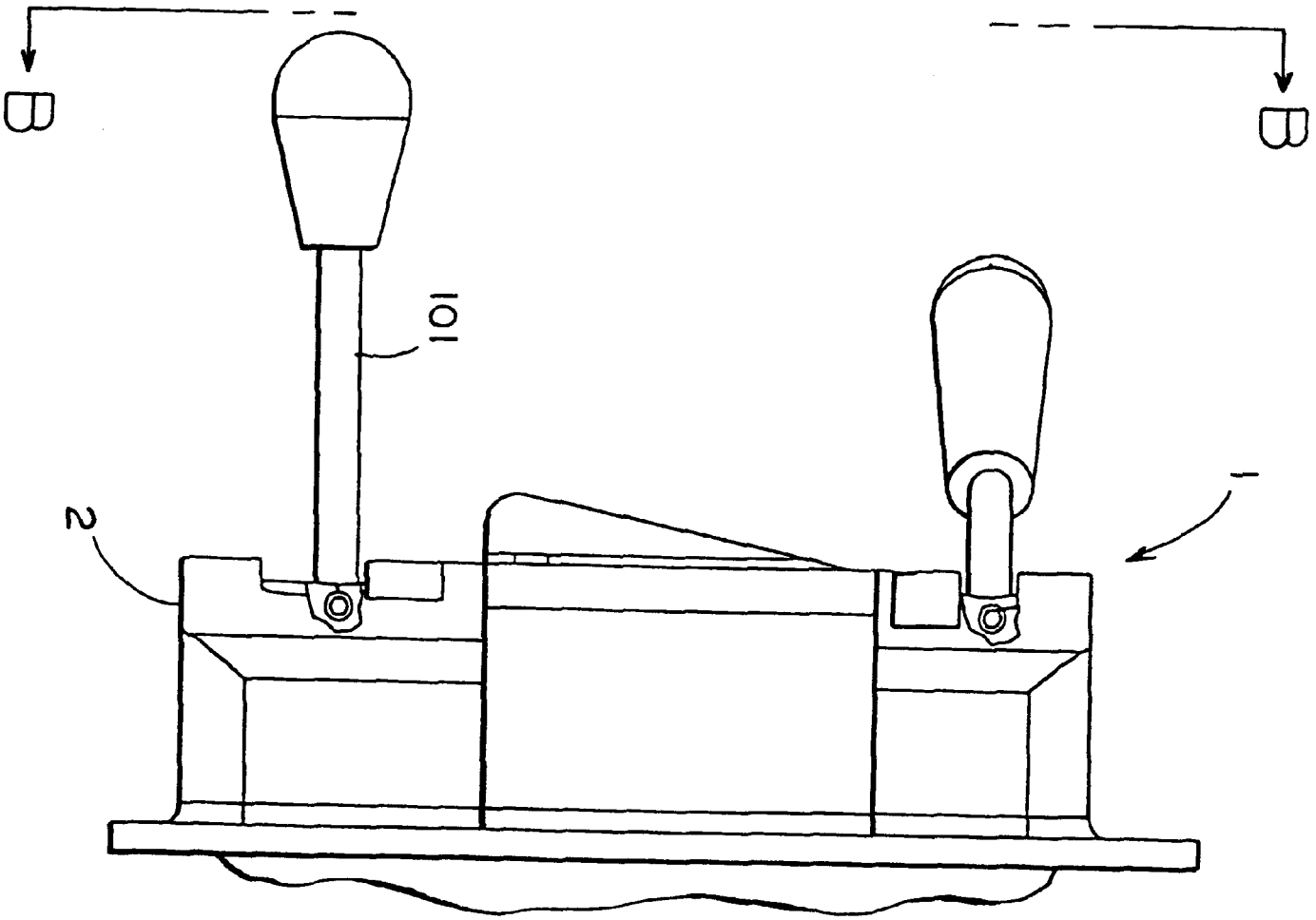
FIG. 2A PRIOR ART
FIG. 2A is a right side view of the handle unit as shown in FIG. 1 from section A—A.
Figure 2B:
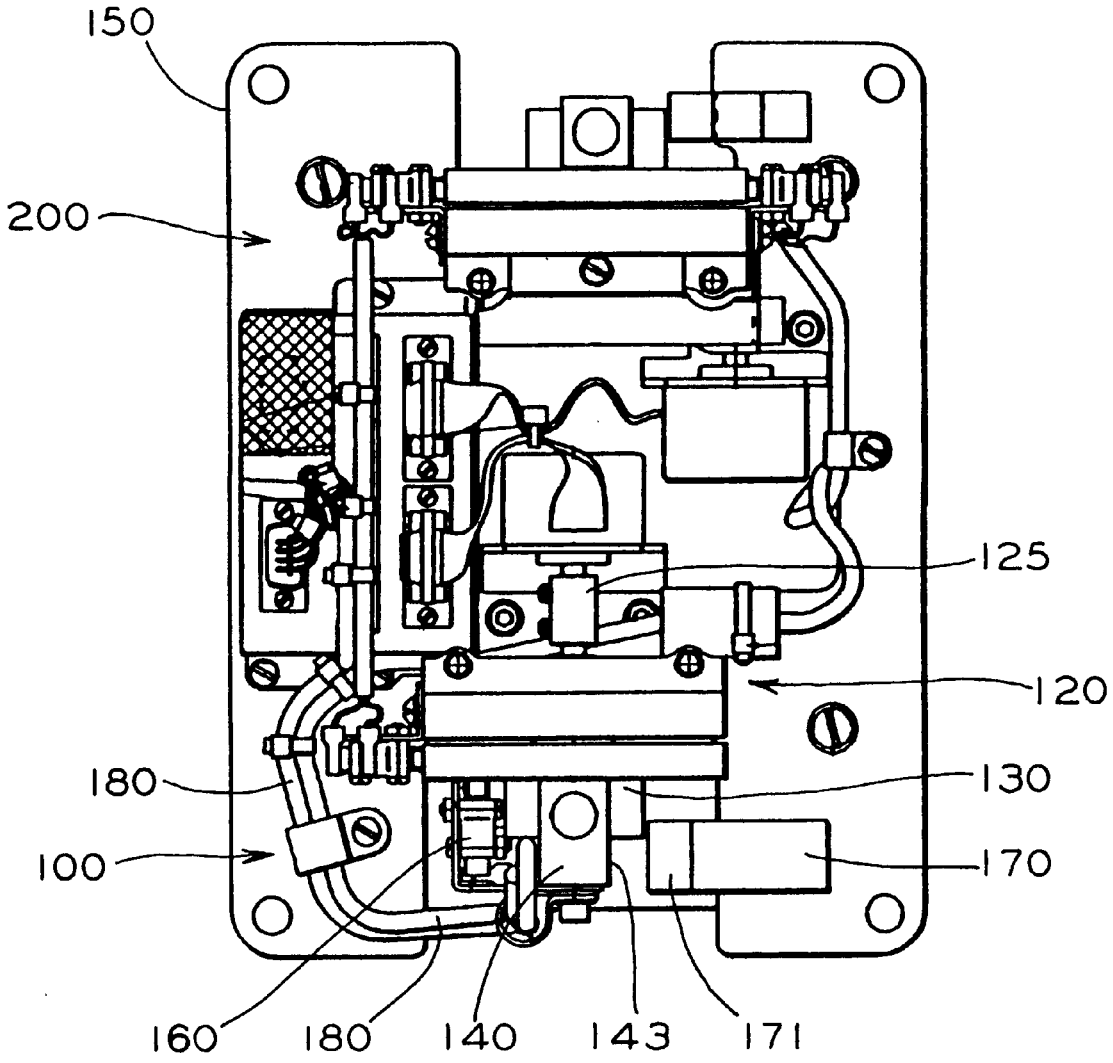
FIG. 2B PRIOR ART
FIG. 2B is a front view of the handle unit, as shown in FIG. 2A from section B—B, with its cover removed to illustrate the internal construction of the automatic and independent brake handle assemblies.
Figure 3:
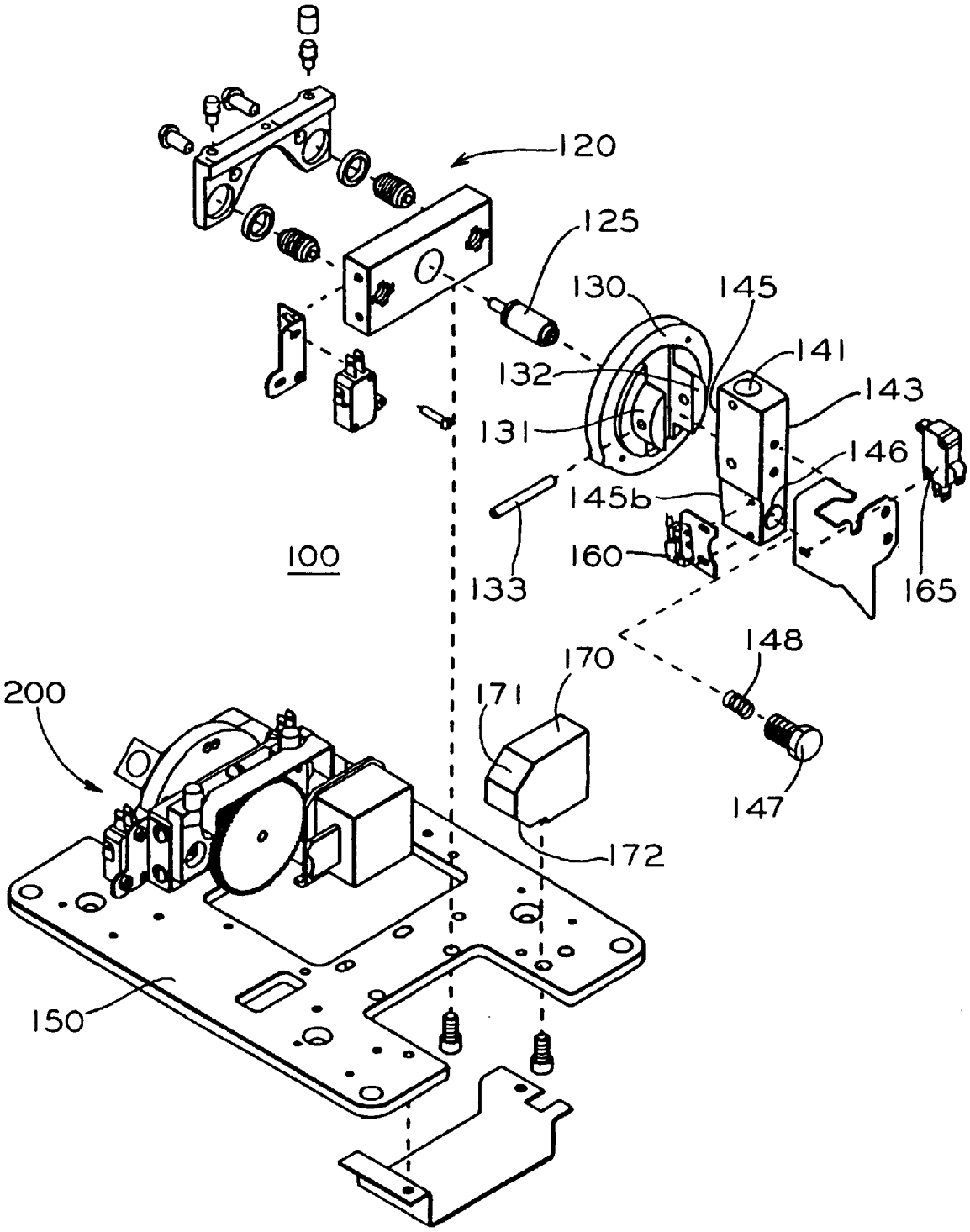
FIG. 3 PRIOR ART
FIG. 3 is a partial, exploded view of a handle unit of the type shown in FIGS. 1 and 2A illustrating how the automatic and independent handle assemblies are constructed.

FIGS. 2B and 3 illustrate an independent brake handle assembly 100 of a cab control unit 1 for a railway locomotive. This particular independent brake handle assembly 100 is a known mechanism whose construction and operation is shown and explained in Operation & Maintenance Manual Document No. 4208-32, Rev. Date 8/96, published by WABCO. It is described here only to the extent necessary to illustrate the environment in which the invention described below is preferably used.

FIG. 3 shows the independent and automatic brake handle assemblies 100 and 200, both of which are built upon and include a common foundation, namely, base plate 150. Among other parts whose constructions and functions are known in the art to which the ensuing invention pertains, the independent brake handle assembly 100 employs base plate 150, a cam mount 120, a cam disk 130, a shaft assembly 125, a yoke 140 and two microswitches 160 and 165. The actuation (or bail off) switch 160 is normally open whereas the loss of power (LOP) bail off switch 165, though of the normally closed type, is normally biased to the open state in the manner described below.

The cam mount 120 is attached to base plate 150 by screws, as best shown in FIG. 3. The shaft assembly 125 is used to interconnect cam mount 120 and cam disk 130 so as to allow cam disk 130 to be rotated. Using retaining pin 133, the yoke 140 is pivotally connected near its centerline to the other side of cam disk 130 between hinges 131 and 132. Below its centerline, the yoke on the lower part 145*b* of its surface 145 is slanted inwardly at approximately a seven degree (7°) angle. The yoke at its top end defines a bore 141 or other receptacle into which secures the lower end of a lever type handle 101.

The yoke 140 also defines a bore 146 transversely through its bottom end into which a retainer 147 is screwed. A spring 148 is carried by retainer 147, as shown in FIG. 3. When retainer 147 is screwed into yoke 140, this spring protrudes from surface 145*b* so as to be in compression between the inside end of retainer 147 and the face of cam disk 130, below hinges 131 and 132, to which slanted surface 145*b* corresponds. By its compression, spring 148 biases handle 101 and yoke 140 in an untilted state wherein it also compels the normally closed contacts of the LOP bail off switch to assume the open state. Given the slant of surface 145*b*, this hinge and spring arrangement allows handle 101 (and yoke 140 therewith) to be tilted from vertical (from the perspective of FIG. 3) with respect to cam disk 130 by approximately seven degrees (7°).

Yoke 140 and cam disk 130 thus rotate as handle 101 is moved along its range of motion. Viewed from the perspective of FIG. 1, the range of motion for handle 101 is nearly lateral from its release position at the left through the application zone to its full apply position on the right. The extent of rotation for handle 101 over its entire range of motion is approximately ninety degrees (90°).

It should be noted that there are two types of cab control units. On one type, the 26 Style Cab Control Unit shown in FIG. 1, the handle unit 2 is oriented vertically. The handle 101 for the 26 Style Unit is to be moved laterally along its range of motion and is to be tilted downwardly when placing it in the actuation position. On another type, the 30 Style Cab Control Unit (not shown), the handle unit is mounted horizontally, i.e., handles pointing upwardly as if the unit were mounted on a table. For the 30 Style Unit, the handle is to be moved back and forth along its range of motion and is to be tilted to the right when placing it in the bail off position.

Referring again to FIGS. 2B and 3, the handle 101 is limited to its ninety degree range of motion by stop block 170. Attached to base plate 150, as best shown in FIG. 3, the stop block has a first stop surface 171 and a second stop surface 172. The first stop surface 171 is used as a barrier to prevent rotation of yoke 140 beyond the full apply position by virtue of contact with the upper part of surface 143. Similarly, the second stop surface 172 is used as a barrier to prevent rotation of yoke 140 beyond the release position by virtue of contact with the lower part of surface 143. Stop block 170 thus prevents the handle 101 (and thus yoke 140 and cam disk 130) from being rotated beyond the ninety degree range of motion.

As shown in FIGS. 2B and 3, the bail off microswitch 160 and the LOP bail off microswitch 165 both mount to and, therefore, move along with the yoke 140. When handle 101 is tilted to and held in the actuation position while the railcar and locomotive brakes are applied via the automatic brake handle, the bail off and LOP bail off microswitches 160 and 165 are both compelled to assume the closed state.

Regarding the purpose for the bail off switch 160, the cab control computer monitors the bail off switch via harness 180 as shown in FIG. 2B. When the bail off switch closes, a circuit is completed and the cab control computer conveys a signal indicative of the closure to the brake control computer. The brake control computer responds by commanding the IAR control portion to charge the actuating pipe. Specifically, the IAR control portion contains a quick release magnet valve (QRMV) that the brake control computer energizes thereby allowing air from the main reservoir to charge the actuating pipe. Once the No. 13 pipe is pressurized to approximately 25 psi, the aforementioned pressure switch 13A closes. The brake control computer senses closure of the pressure switch and responds by commanding the BC control portion to release the pressure from the brake cylinders of the locomotive. The brake control computer will continue to allow the pressure to drop as long as the handle is held (i.e., tilted) in the bail off position.

The handle can be allowed to move (i.e., untilt) out of its bail off position at any time. Then, depending on the position that handle 101 currently occupies or to which it is rotated in its range of motion, the brake control computer will command the BC control portion to keep the locomotive brake cylinders at whatever pressure they currently retain or to increase their pressure to the desired level. The independent brake handle 101 can thus be used to bail off the locomotive brakes while keeping the railcar brakes engaged.

Regarding the purpose for the LOP bail off switch 165, should the train suffer a loss of power, both the railcar and the locomotive brakes can be applied in an emergency by moving the automatic brake handle to the emergency position. For a locomotive operating in the previously described LEAD CUT-IN mode, pressure will then be developed in the brake cylinders of both the locomotives and the railcars of the train via special pneumatic back-up brake equipment.

Certain railroad operating authorities have requested that their locomotives be capable of bailing off the locomotive brakes under such loss of power conditions. For those customers, the independent brake handle assembly 100 via its LOP bail off switch 165 can be used to actuate the locomotive brakes while keeping the railcar brakes engaged. Under loss of power conditions, a relay known as the LOP relay deenergizes in which state it connects the power side of the QRMV to back up power circuitry. When handle 101 is tilted to the actuation position, LOP bail off switch 165 is compelled to close thereby providing ground to the return side of the QRMV. Consequently, when handle 101 is tilted to the actuation position under loss of power conditions, the QRMV of the IAR control portion energizes thereby allowing air from the main reservoir to charge the No. 13 pipe. The BC control portion then responds by reducing the pressure in the brake cylinders of the locomotive. The pressure in the locomotive brake cylinders will continue to be bailed off (i.e., actuated) as long as the independent brake handle is held (i.e., tilted) in the actuation position.

The harness 180, as best shown in FIG. 2B, is used to connect the terminals of the actuation and LOP bail off microswitches to the cab control computer and/or other electrical circuitry. Consequently, the harness 180 must endure a considerable amount of flexing whenever the handle (and yoke 140 to which the switches mount) is rotated along its range of motion and/or tilted to its bail off position. As it is attached to the top end of yoke 140, the LOP bail off switch 165 is situated where it is at great risk of damage by objects that could protrude through the opening for handle 101 in the cover of the handle unit 2. Moreover, the actuation switch 160, attached to the bottom end of the yoke, requires periodic adjustment of its actuating leaf due to such movement of the harness 180. Due to the solder type connections, the mounting of the two microswitches on the yoke and the stresses of movement, this microswitch and harness arrangement has been shown to be prone to damage.

The construction and operation of the independent brake handle assembly 100 has been described herein to the extent necessary to understand the environment in which the ensuing invention is preferably intended to be used. It should be understood, however, that this constitutes a brief and simplified explanation of how the prior art handle assembly 100 works and its role in the brake control system of a train.

Figure 4:
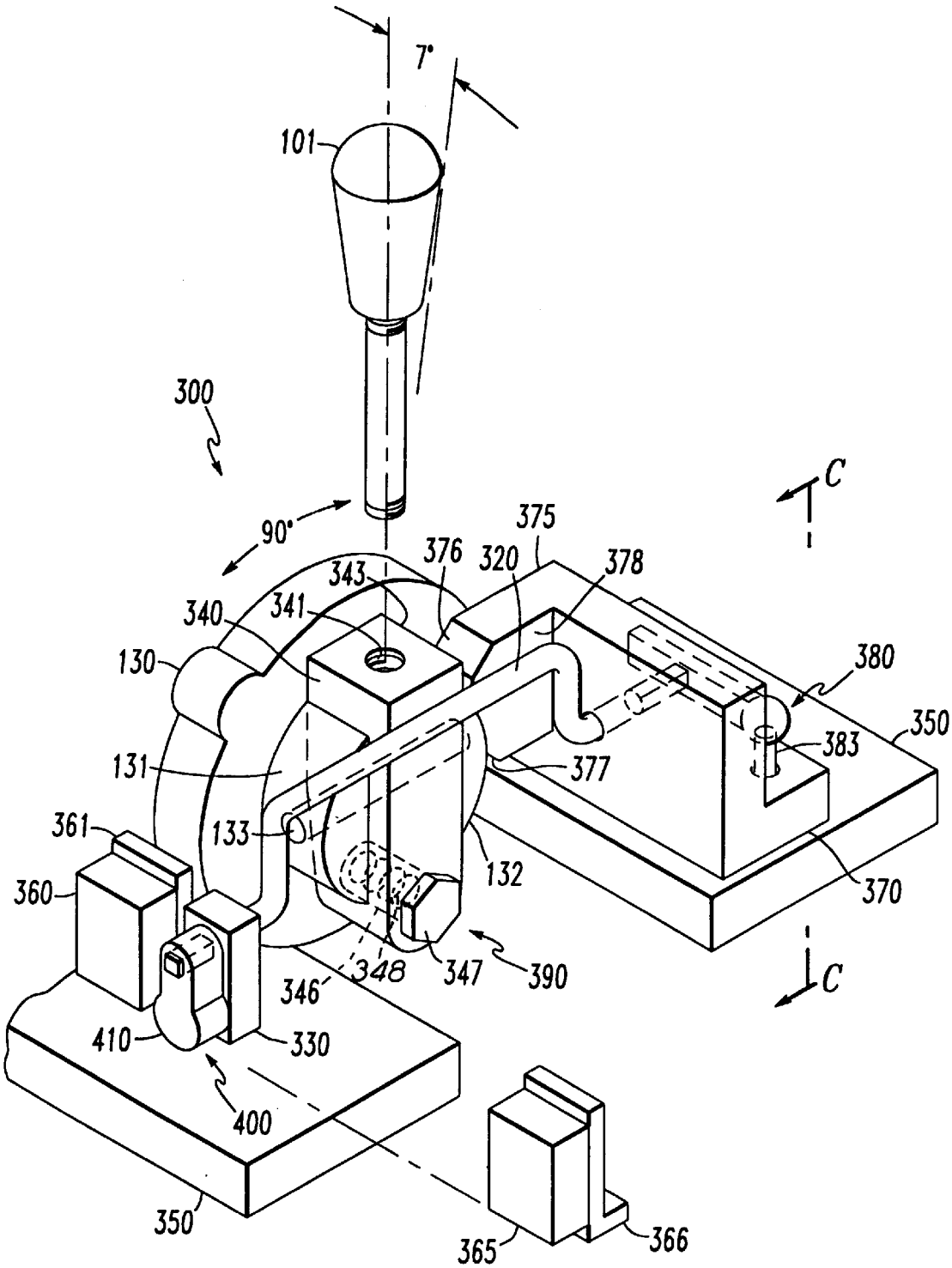
FIG. 4 is a perspective view of an improved independent brake handle assembly that can be substituted for the independent brake handle assembly shown in FIGS. 2B and 3.
Figure 5:
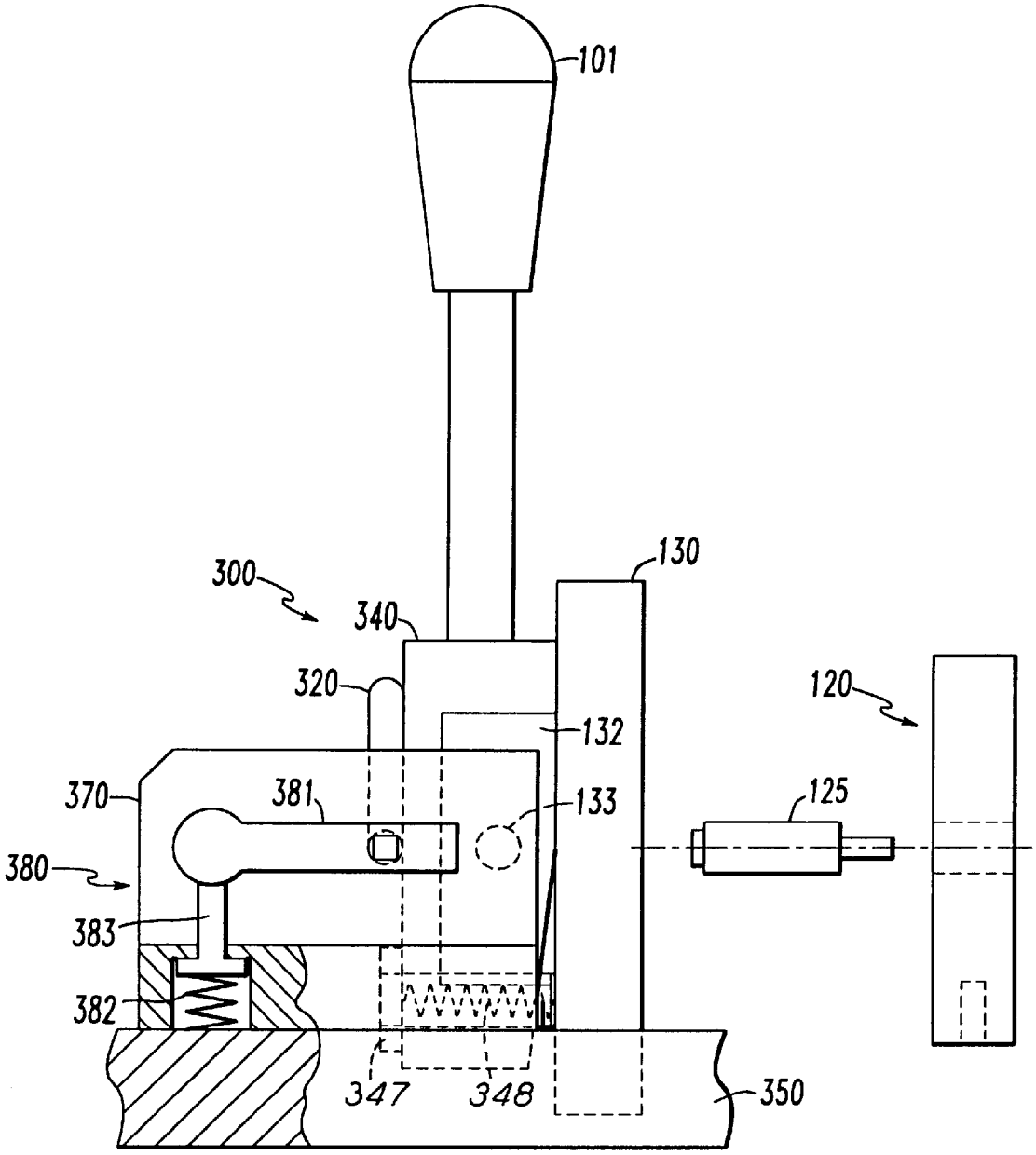
FIG. 5 is a side view of the improved independent brake handle assembly as shown in FIG. 4 from section C—C.

Having now described the environment in which the invention is preferably used, FIGS. 4 and 5 illustrate the invention—an improved independent brake handle assembly 300. The improved assembly 300 includes a base plate 350, a cam mount 120, a cam disk 130, a shaft assembly 125, a yoke 340, an actuation (or bail off) microswitch 360 and a loss of power (LOP) bail off microswitch 365. The improved handle assembly 300 further includes a bail bar 320, a first bearing member 330 and a second bearing member 370.

The base plate 350 features the new mounting holes that are necessary to accommodate the new components, e.g., the holes used to mount the first and second bearing members 330 and 370 and the switches 360 and 365. The cam mount 120 attaches to base plate 350 typically by screws and the shaft assembly 125 interconnects cam mount 120 and cam disk 130, as shown in FIG. 5, so as to allow cam disk 130 to be rotated. The actuation and LOP bail off microswitches 360 and 365 each attach to base plate 350 preferably by means of a bracket such as the type denoted by reference numerals 361 and 366 in FIG. 4.

As yoke 340 does not accommodate any switches, it can be considerably smaller than the prior art yoke 140. A retaining pin, such as pin 133 shown in FIG. 3, pivotally connects the yoke 340 approximate its centerline to the other side of cam disk 130 between hinges 131 and 132. Below its centerline, however, the yoke 340 on its lower part still retains the inwardly slanted surface that faces cam disk 130. Like the slanted surface 145*b* shown in FIG. 3, this surface is inclined inwardly by approximately seven degrees (7°). The top end of yoke 340 defines bore 341 or other receptacle into which secures the lower end of the lever type handle 101.

Yoke 340 and cam disk 130 thus both rotate as handle 101 is moved along its range of motion. Viewed from the perspective of FIG. 4, the handle 101 resides in the application zone with the release position to the right and the full apply position to the left. Moving the handle through its entire range of motion causes the combined yoke and cam disk assembly to rotate by approximately ninety degrees (90°).

The first and second bearing members 330 and 370 attach by screws or similar means to base plate 350. Each member features bearings or similar apparatus in which to hold the respective ends of bail bar 320 so that the bail bar in its entirety can be rotated. The bail bar 320 is shaped so that its middle section is not coaxial with its ends. As shown in FIG. 4, bail bar 320 may be shaped somewhat like a handle for a bucket with its middle section upraised with respect to its ends. The middle section, for example, may take the shape of a rectangle or of a semicircle. As described below, this allows the middle section to operate against the upper portion of yoke 340 on the side of yoke 340 opposite cam disk 130.

The improved handle assembly 300 further features a means 380 for imparting a rotational force to bail bar 320 so that its middle section forcibly presses against the upper portion of yoke 340. In its preferred embodiment, this means includes a tension arm 381, spring 382 and plunger 383. As best shown in FIG. 5, tension arm 381 is rotatable with and has a tail end affixed to that end of bail bar 320 that protrudes through the second bearing member 370. Preferably, tension arm 381 defines a bore in its tail end within which the second end of bail bar 320 anchors. Spring 382 is preferably housed in a bore defined in the base of second bearing member 370. Plunger 383 serves as a cap on top of spring 382. Under compression by virtue of the angle at which tension arm 381 is disposed, the spring 382 and plunger 383 operate against the head end of tension arm 381. As viewed from the perspective of FIG. 4, the means 380 compels the bail bar 320 by inward rotation to force its middle section against the upper portion of yoke 340.

The second bearing member 370 features a stop block 375 to prevent the yoke 340 and handle therewith from moving beyond the release and full apply positions. The first surface 376 of stop block 375 prevents rotation of yoke 340 beyond the full apply position by virtue of contact with the upper part of surface 343. The second surface 377 of block 375 prevents rotation of yoke 340 beyond the release position by virtue of contact with the lower part of surface 343. Stop block 375 thus prevents the handle 101 (and thus yoke 340 and cam disk 130) from being rotated beyond the ninety degree range of motion.

Stop block 375 also limits the rotation of bail bar 320 to the point at which the handle and yoke attain the untilted state. The perspective view of FIG. 4 illustrates that surface 378 of block 375 serves as a barrier that prevents bail bar 320 from rotating to the point at which both the yoke and handle would be forced inwardly beyond the untilted state.

The improved handle assembly 300 further features a means 390 for providing a counterbalancing force to normally bias the yoke and handle in the untilted state. The means 390 is preferably designed to operate against the lower portion of the yoke. In its preferred embodiment, this means includes a bore 346, retainer 347 and spring 348. The bore 346 is defined transversely through the bottom end of yoke 340. Bore 346 is smaller than the bore 146 shown in FIG. 3 due, at least in part, to the smaller size of yoke 340. Designed to screw or otherwise secure into bore 346, retainer 347 carries spring 348 in a manner similar to that shown in FIG. 3. When retainer 347 is secured into yoke 340, the other end of spring 348 protrudes from the slanted surface so as to be in compression between the inside end of retainer 347 and the face of cam disk 130, preferably below hinges 131 and 132, to which the slanted surface corresponds. Spring 348 thus biases yoke 340 and handle 101 in the untilted state. Given the incline of the slanted surface of yoke 340, this hinge and spring arrangement also allows handle 101 (and yoke 340 therewith) to be tilted with respect to cam disk 130 by approximately seven degrees (7°) against the rotational force that operates on bail bar 320. Moving the handle perpendicularly to its range of motion causes this tilting of the handle and yoke assembly.

The improved handle assembly 300 also includes a means 400 for engaging the actuation and LOP bail off microswitches 360 and 365. In its preferred embodiment, this engaging means features a trip arm denoted by reference numeral 410 in FIG. 4. The tail end of trip arm 410 is rotatable with and affixed to that end of bail bar 320 that protrudes through the first bearing member 330. Preferably, the trip arm defines a bore in its tail end within which the first end of bail bar 320 anchors. The head end of trip arm 410 is disposed between, and can therefore engage both of, the microswitches 360 and 365. No matter where it is positioned along its range of motion, when the handle 101 is tilted by approximately seven degrees or by any other preset amount, the yoke 340 moves against the rotational force of bail bar 320 and further compresses spring 348. As the independent brake handle 101 is so tilted, the bail bar 320 rotates outwardly as viewed from the perspective of FIG. 4. This causes trip arm 410 to rotate about its tail end so that its head end causes both the actuation switch 360 and the LOP bail off switch 365 to change state.

Due to the environment in which the invention is preferably intended to be used, the actuation microswitch 360 is preferably of the normally open type whereas the LOP bail off switch 365 is preferably of the normally closed type. As for the former, when the handle is tilted to the bail off position, the actuation switch 360 closes thereby completing a circuit in response to which the cab control computer conveys the aforementioned signal indicative of such closure to the brake control computer. As for the latter, the LOP bail off switch 365 has three internal contacts (common, open and closed) and a lever to engage them. When handle 101 occupies the untilted state, the head end of trip arm 410 forces this lever to connect the common and closed contacts. When the handle is tilted to the bail off position, however, this lever returns to its default position in which it connects the common and open contacts of LOP bail off switch 365 thereby providing a ground connection to the aforementioned return side of the QRMV. Consequently, when the independent brake handle is tilted to the actuation position under loss of power conditions, the LOP bail off switch 365, in conjunction with the LOP relay, enables the QRMV of the IAR control portion to energize thereby allowing air from the main reservoir to charge the No. 13 pipe.

It should be noted that each of the foregoing means (i.e., 380, 390 and 400) may be implemented using various other arrangements of the same parts or even different parts that together perform the same function as the previously described structure. The ensuing claims are therefore intended to encompass all of these mechanisms and any variations thereof.

The presently preferred embodiment for carrying out the invention has now been set forth in detail according to the Patent Act. Those persons of ordinary skill in the art to which this invention pertains may, nevertheless, recognize various alternative ways of practicing the invention without departing from the spirit and scope of the following claims. Those of such skill will also recognize that the foregoing description is merely illustrative and not intended to limit any of the ensuing claims to any particular narrow interpretation.

Accordingly, to promote the progress of science and useful arts, we secure for ourselves by Letters Patent exclusive rights to all subject matter embraced by the following claims for the time prescribed by the Patent Act.

We claim:

1. An improvement to a handle assembly of the type having a base plate, a cam mount attached to said base plate, a cam disk a shaft assembly interconnecting said cam mount and said cam disk to allow rotation of said cam disk, and a yoke pivotally secured to said cam disk and accommodating a handle such that said yoke rotates along with said cam disk as said handle is moved along a range of motion and tilts as said handle is moved normal to said range of motion, said improvement comprising:

(a) first and second bearing members each attached to said base plate, said second bearing member including a stop block to prevent said yoke and said handle therewith from moving beyond first and a last positions in said range of motion;

(b) a bar having (i) a first end rotatable within and protruding through said first bearing member (ii) a second end rotatable within and protruding through said second bearing member, and (iii) a middle section operable against an upper portion of said yoke on a side thereof opposite said cam disk;

(c) a means for imparting a rotational force to said bar so that said middle section thereof presses against said yoke;

(d) said stop block further acting to limit rotation of said bar against said yoke to a point at which said yoke and said handle therewith attain an untilted state;

(e) a means, operable against a lower portion of said yoke, for providing a counterbalancing force to normally bias said yoke and said handle therewith in said untilted state;

(f) first and second switches each attached to said base plate; and (g) an engaging means, operable with said bar, for engaging said switches such that no matter where said handle is positioned along said range of motion, when said handle is tilted by a preset amount, said yoke overcomes said rotational force of said bail bar and said counterbalancing force to cause said engaging means to change the state of said switches.

2. The improved handle assembly recited in claim 1 wherein said means for imparting said rotational force includes:

(a) a tension arm rotatable with and having a tail end affixed to said second end of said bar that protrudes through said second bearing member; and (b) a spring loaded plunger disposed within said second bearing member to operate against a head end of said tension arm thereby compelling said bail bar by rotation to force said middle section thereof against said yoke.

3. The improved handle assembly recited in claim 1 wherein said engaging means includes a trip arm having (i) a tail end rotatable with and affixed to said first end of said bar that protrudes through said first bearing member and (ii) a head end disposed between and engageable with said switches; so that while said handle is tilted by said preset amount, said head end of said trip arm causes said switches to change state.

4. The improved handle assembly recited in claim 1 wherein said means for providing said counterbalancing force includes a spring in compression between said lower portion of said yoke and an opposing face of such cam disk.

5. The improved handle assembly recited in claim 1 wherein each of said switches is attached to said base plate by means of a bracket.

6. The improved handle assembly recited in claim 1 wherein said range of motion is approximately ninety degrees between said first and said last positions.

7. The improved handle assembly recited in claim 1 wherein said preset amount that said handle can be tilted is approximately seven degrees from said untilted state.

8. An improvement to a handle assembly having a base plate, a cam mount attached to said base plate, a cam disk and a shaft assembly interconnecting said cam mount and said cam disk to allow rotation of said cam disk, said improvement comprising:

(a) a yoke secured to said cam disk, said yoke for accommodating a handle such that said yoke rotates along with said cam disk as said handle is moved along a range of motion and tilts as said handle is moved normal to said range of motion;

(b) first and second bearing members each attached to said base plate;

(c) a bar having (i) a first end rotatable within and protruding through said first bearing member, (ii) a second end rotatable within and protruding through said second bearing member and (iii) a middle section operable against an upper portion of said yoke on a side thereof opposite said cam disk;

(d) a means for imparting a rotational force to said bar so that said middle section thereof is pressed against said yoke;

(e) a stop block to (i) prevent said yoke and said handle therewith from moving beyond a first and a last position in said range of motion and (ii) limit rotation of said bar against said yoke to a point at which said yoke and said handle therewith attain an untilted state;

(f) a means, operable against a lower portion of said yoke, for providing a counterbalancing force to normally bias said yoke and said handle therewith in said untilted state;

(g) a first switch attached to said base plate; and (h) an engaging means, operable with said bar, for engaging said first switch such that no matter where said handle is positioned along said range of motion, when said handle is tilted by a preset amount, said yoke overcomes said rotational force of said bar and said counterbalancing force to cause said engaging means to change the state of said first switch.

9. The improved handle assembly recited in claim 8 wherein said means for imparting said rotational force includes:

(a) a tension arm rotatable with and having a tail end affixed to said second end of said bar that protrudes through said second bearing member; and (b) a spring loaded plunger disposed within said second bearing member to operate against a head end of said tension arm thereby compelling said bar by rotation to force said middle section thereof against said yoke.

10. The improved handle assembly recited in claim 8 wherein said engaging means includes a trip arm having (i) a tail end rotatable with and affixed to said first end of said bar that protrudes through said first bearing member and (ii) a head end engageable with said first switch; so that while said handle is tilted by said preset amount, said head end of said trip arm causes said first switch to change state no matter where said handle is positioned along said range of motion.

11. The improved handle assembly recited in claim 8 wherein said second bearing member and said stop block are combined into a single part.

12. The improved handle assembly recited in claim 8 further including a second switch attached to said base plate such that said engaging means is disposed between said first and said second switches so that when said handle is tilted by said preset amount, said yoke overcomes said rotational force of said bail bar and said counterbalancing force so that said engaging means causes said first and said second switches to change state.

13. The improved handle assembly recited in claim 12 wherein each of said switches is attached to said base plate by means of a bracket.

14. The improved handle assembly recited in claim 8 wherein said range of motion is approximately ninety degrees between said first and said last positions.

15. The improved handle assembly recited in claim 8 wherein said preset amount that said handle can be tilted is approximately seven degrees from said untilted state.

16. A handle assembly for a railway locomotive, said handle assembly comprising:

(a) a base plate;

(b) a cam mount attached to said base plate;

(c) a cam disk;

(d) a shaft assembly interconnecting said cam mount and said cam disk to allow rotation of said cam disk;

(e) a yoke pivotally secured to said cam disk, said yoke for accommodating a handle such that said yoke rotates along with said cam disk as said handle is moved along a range of motion and tilts as said handle is moved normal to said range of motion;

(f) first and second bearing members each attached to said base plate, said second bearing member including a stop block to prevent said handle and said yoke therewith from moving beyond a first and a last position in said range of motion;

(g) a bar having (i) a first end rotatable within and protruding through said first bearing member, (ii) a second end rotatable within and protruding through said second bearing member and (iii) a middle section operable against an upper portion of said yoke on a side thereof opposite said cam disk;

(h) a means for imparting a rotational force to said bar so that said middle section thereof presses against said yoke;

(i) said stop block further acting to limit rotation of said bar against said yoke to a point at which said yoke and said handle therewith attain an untilted state;

(j) a means, operable against a lower portion of said yoke, for providing a counterbalancing force to normally bias said yoke and said handle therewith in said untilted state;

(k) first and second switches each attached to said base plate; and (l) an engaging means, operable with said bar, for engaging said switches such that no matter where said handle is positioned along said range of motion, when said handle is tilted by a preset amount, said yoke overcomes said rotational force of said bar and said counterbalancing force to cause said engaging means to change the state of said switches.

17. The handle assembly recited in claim 16 wherein said means for imparting said rotational force includes:

(a) a tension arm rotatable with and having a tail end affixed to said second end of said bar that protrudes through said second bearing member; and (b) a spring loaded plunger disposed within said second bearing member to operate against a head end of said tension arm thereby compelling said bar by rotation to force said middle section thereof against said yoke.

18. The handle assembly recited in claim 16 wherein said engaging means includes a trip arm having (i) a tail end rotatable with and affixed to that part of said first end of said bar that protrudes through said first bearing member and (ii) a head end disposed between and engageable with said switches; so that while said handle is tilted by said preset amount, said head end of said trip arm causes both of said switches to change state.

19. The handle assembly recited in claim 16 wherein said means for providing said counterbalancing force includes a spring in compression between said lower portion of said yoke and an opposing face of said cam disk.

20. The handle assembly recited in claim 16 wherein said middle section has an axis that is offset from a longitudinal axis shared by said first and second ends of said bar.

* * * * *